United States Patent [19]

Baraff et al.

[11] 4,074,109

[45] Feb. 14, 1978

[54] THERMAL PRINT BAR

[75] Inventors: David Robbin Baraff; Robert James Boynton, Ottawa; Frederick Caldwell Livermore, Kanata, all of Canada

[73] Assignee: Northern Telecom Limited, Montreal, Canada

[21] Appl. No.: 815,794

[22] Filed: July 15, 1977

[51] Int. Cl.[2] ..... H05B 1/00

[52] U.S. Cl. ..... 219/216; 219/543; 346/76 R

[58] Field of Search ..... 219/216, 543; 346/76 R; 29/611; 427/123-126

[56] References Cited

U.S. PATENT DOCUMENTS 3,967,092 6/1976 Conta et al. ..... 219/216

4,017,712 4/1977 Baraff et al. ..... 219/216

*Primary Examiner*—C. L. Albritton

*Attorney, Agent, or Firm*—Sidney T. Jelly

[57] ABSTRACT

A thermal printing bar, as for a facsimile printer, has a pattern of associated conductors on each side thereof to produce two rows of hot spots in the printing bar. The hot spots in one row are offset relative to the other row. By suitably sizing the hot spots, the spots in one row will at least completely fill the gaps between the spots in the other row, or can even overlap. By this means, the one row is first printed on the paper; the paper moved by the distance between the centers of the rows and then the other row printed. This provides contiguous or overlapping spots on the paper, giving improved contrast.

10 Claims, 5 Drawing Figures

THERMAL PRINT BAR

This invention relates to a thermal print bar and in particular a thermal print bar which produces contiguous or overlapping dots to give improved printing quality, and to thermal printing apparatus incorporating such print bars.

Print contrast is an important feature in legibility and quality. Conventional printers produce a dot which is smaller than the element size, that is the dot does not completely fill the area allotted to it. As an example, a 3 mil square in a 5 mil square element will give a contrast ratio of 1.57 which is poor. A 5 mil × 3 mil rectangle in a 5 mil square will give a contrast ratio of 2.5. Both these ratios are too small, a good ratio being about 8.

A problem of increasing contrast ratio with conventional print bars is that electrical isolation of adjacent elements reduces the dot size relative to the element area, and contrast ratios in excess of about 2.5 are difficult to obtain.

The present invention provides improved contrast ratios by creating overlapping, or at least abutting, of the print dots. This is obtained by printing alternate dots in a line, moving the paper and then printing the intervening dots. The invention will be readily understood by the following description of certain embodiments, by way of example, in conjunction with the accompanying drawings, in which.

Figure 1:
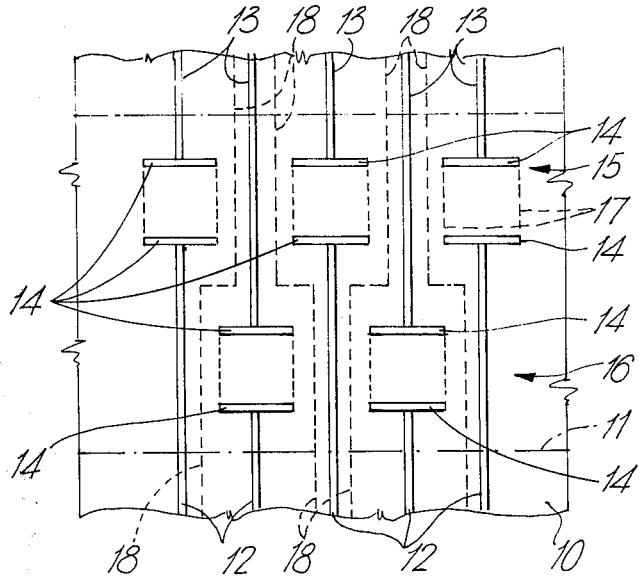
FIG. 1 is a diagrammatic plan view of one printing element layout.
Figure 3:
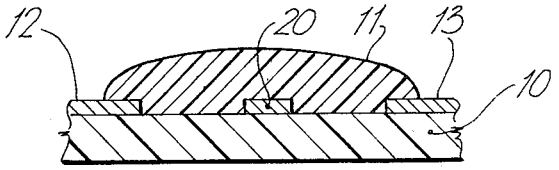
FIG. 3 is a cross-section on the line III—III of FIG. 2.

Basically, as illustrated in FIG. 1, the printing points or positions are offset alternatively in a direction parallel to the direction of movement of the paper. Thus, in FIG. 1, on a substrate or support member 10, a continuous bar of electrically resistive material 11 is deposited. Beneath the bar 11 a pattern of conductors 12 and 13 is provided. Conductors 12 extend from one side of the bar 11 and alternate conductors extend further beneath the bar. On the other side the conductors 13 extend in opposition to conductors 12 and each conductor 13 extends to the same distance from the related conductor 12. Thus alternate conductors 13 also extend further beneath the bar but staggered relative to conductors 12. The opposed ends 14 of conductors 12 and 13 are shown extended laterally to form two rows of print elements 15 and 16 extending along the bar 11, the print elements 15 offset relative to the print elements 16, in the direction of the longitudinal axis of the bar.

Application of a voltage to an opposed pair of conductors 12, 13 will result in a hot spot between the two related ends 14, generally as indicated by the dotted lines 13. By energizing first the conductors associated with the top row of elements in FIG. 1, row 15, and then moving the paper being printed upon downwards a distance equal to the distance between the centres of the rows 15 and 16 and then energizing the conductors associated with the bottom row of elements, row 16, a complete line can be printed. Depending upon the actual image being reproduced, so relevant elements in each row are energized.

To improve electrical isolation, laser scribing can be affected across the bar 11, as indicated by the dotted lines 18. To reduce the complexity of the conductor patterns the conductors 13 are multiplexed, for example as illustrated in FIG. 4.

Figure 2:
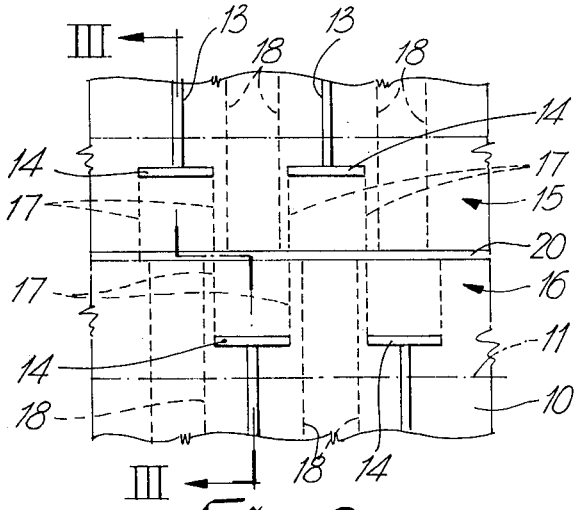
FIG. 2 is a diagrammatic plan view of an alternative printing element layout.

FIG. 2 illustrates an alternative arrangement which halves the number of conductors extending from under the bar 11. In this arrangement there is a common central conductor 20 extending along beneath the bar 11. Conductors 12 and 13 extend beneath the bar from each side but extend only to the outer side of each print element. The inner side of each print element is formed by the central conductor 20. The extent of the hot spots is again indicated by the dotted lines 17. Laser scribing can be used as indicated at 18.

In the examples of FIGS. 1 and 2, the printed dots will effectively abut each other. It is possible, by extending the ends 14, particularly in the arrangement illustrated in FIG. 2, to make the printed dots wider and thus overlap to ensure a continuous print.

Figure 4:
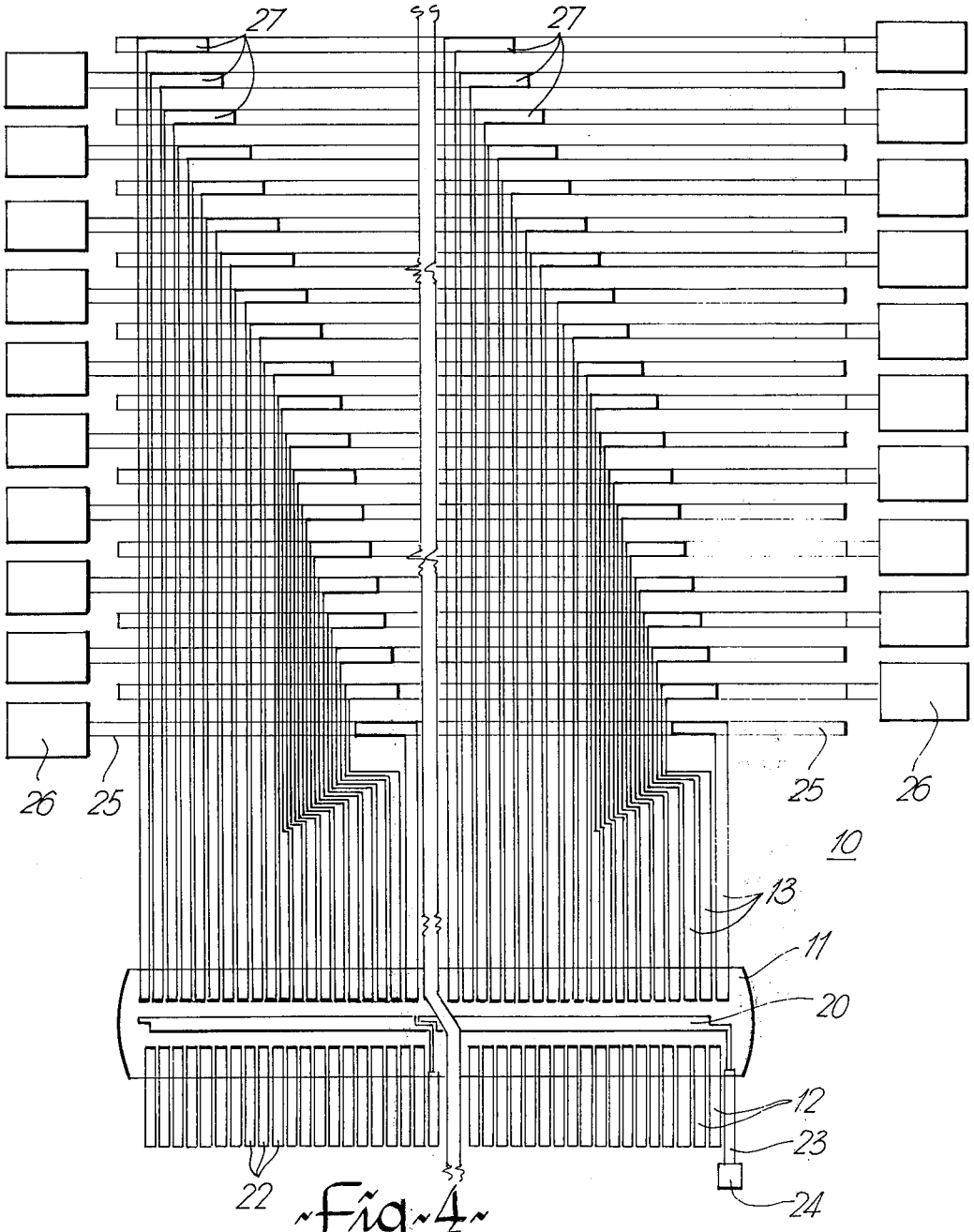
FIG. 4 is a plan view of a conductor and print bar pattern for a thermal printing bar device having an arrangement as in FIGS. 2 and 3.

FIG. 4 illustrates one form of conductor pattern as for a facsimile printer, particularly of the form of FIG. 2. The bar is indicated at 11 and the central conductor at 20. The conductors 12 have contact pads 22 at their ends. The central conductor 20 is divided into sections with connections 23 to contact pads 24.

On the other side of the bar 11 the conductors 13 are connected to transverse conductors 25. The transverse conductors extend in rows across the substrate 10 parallel to the bar 11. The conductors 13 are connected sequentially to the transverse conductors 25, that is the right hand conductor 13 for the first column, in FIG. 4, connected to the transverse conductor 25 nearest the bar 11, the next conductor 13 to the next transverse conductor 25, and so on. There are the same number of transverse conductors 25 as there are conductors 12 associated with a section of the central conductor 20. The right hand conductor 13 for each section of conductors 13 is connected to the same transverse conductor 25. This is seen in FIG. 4. Contact pads 26 are provided at alternate ends of transverse conductors 25.

By selectively applying a voltage to a contact pad 26 and one of the contact pads 24 a hot spot can be formed, in FIG. 4, between a conductor 13 and the central conductor 20. By selectively applying a voltage to one of the contact pads 22 and one of the contact pads 24, a hot spot can be formed between a conductor 12 and the central conductor 20.

Various methods may be used to make an arrangement as illustrated in FIG. 4, but a typical one is as follows. On the substrate 10, the transverse conductors 25 are formed, for example by thin film technology. The area occupied by the conductors 25 is then covered by an oxide film, which is then photolithographically etched to provide uncovered areas of the conductors 25 for contact with conductors 13. These areas are indicated at 27. The conductors 12 and 13, 20 and 23 are then formed, again for example by thin film technology. Effectively a complete film of conductor material can be formed on the substrate and then photolithography etched to form the conductor patterns for conductors 12, 13, 20 and 23.

The bar 11 of electrically resistive material is then formed, either by thick film or thin film technology, and the contact pads 23 and 26 also formed.

Figure 5:
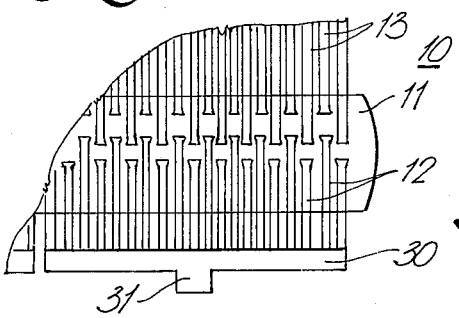
FIG. 5 is a plan view of part of a conductor and print bar pattern illustrating an alternative device having an arrangement as in FIG. 1.

FIG. 5 illustrates the alternative form of conductor pattern to that of FIG. 4, when print elements as illustrated in FIG. 1 are provided. The conductors 13 are connected to transverse conductors 25, in rows, as in FIG. 4 but the conductors 13 extend alternately to different positions under the bar 11 as in FIG. 1. Conductors 12 are interconnected in a series of blocks and columns by a conductor 30 with contact pad 31. Again the conductors 12 extend alternately to different positions under the bar 11, as in FIG. 1. In the arrangement of FIG. 5, by selectively applying a voltage to a pad 26 and one of the conductors 30 a hot spot can be formed between an unique pair of conductors 12 and 13.

An example of resistive material for the bar 11 is an electrically resistive ink, such as supplied under the trade name Dupont 1431. An example of the thin film technology for forming the conductors 25, and also conductors 12 and 13, 20 and 23, is by a three part layer composed of a first layer of titanium for good adhesion, a second layer of palladium which gives good adhesion to the titanium and provides good adhesion for the third layer of gold. The three layers can be formed, for example, by evaporation.

What is claimed is:

1. A thermal print bar comprising:

a substrate of electrically insulating material;

a continuous bar of electrically resistive material on a surface of said substrate;

electrical conductor patterns extending beneath said bar to define two rows of print elements extending along the bar, the print elements of one row offset relative to the print elements of the other row, in the direction of the longitudinal axis of the bar.

2. A print bar as claimed in claim 1, said electrical conductor patterns including electrical conductors extending beneath said bar from each side thereof.

3. A print bar as claimed in claim 2, said electrical conductors extending in opposed pairs substantially normal to the length of the bar, the opposed ends of said conductors being extended laterally in the direction of the longitudinal axis of the bar, to define said print elements.

4. A thermal print bar as claimed in claim 3, the laterally extended ends of the conductors of one row having their extremities in substantial alignment with the extremities of the laterally extended ends of the conductors of the other row.

5. A thermal print bar as claimed in claim 3, the laterally extended ends of the conductors of one row having their extremities overlapping the extremities of the laterally extended ends of the conductors of the other row.

6. A print bar as claimed in claim 2, including a central electrical conductor extending under said bar in the direction of the longitudinal axis of said bar;

the electrical conductors extending from each side of the bar being offset relative to each other in the direction of the longitudinal axis of the bar, and having inner ends spaced from said central conductor, said inner ends being extended laterally, parallel to said central conductor, to define said print elements.

7. A thermal print bar as claimed in claim 6, the laterally extended ends of the conductors extending from one side of said bar having their extremities in substantial alignment with the extremities of the laterally extended ends of the conductors extending from the other side of the bar.

8. A thermal print bar as claimed in claim 6, the laterally extended ends of the conductors extending from one side of said bar having their extremities overlapping the extremities of the laterally extended ends of the conductors extending from the other side of the bar.

9. A thermal print bar as claimed in claim 1, said continuous bar having a reduced cross-section between print elements of a row.

10. A thermal print bar as claimed in claim 1, said electrical conductor patterns comprising:

a first pattern of electrical conductors on said surface of said substrate and extending along one side of said bar and first electrical connectors extending from said first pattern to said bar, said first electrical connectors connected to said bar at said one side in a closely spaced predetermined arrangement extending along the bar, said first pattern of electrical conductors comprising a plurality of columns, each column electrically separate from other columns, and a plurality of said first electrical connectors extending side by side from each of said columns to said bar of electrically resistive material;

a second pattern of electrical conductors on said surface of said substrate and extending along the other side of said bar, and second electrical connectors from said second pattern to said bar, said second electrical connectors connected to said bar at said other side in a closely spaced predetermined arrangement extending along the bar and opposed to said first electrical connectors, said second pattern of electrical conductors comprising a plurality of rows, each row electrically separate from other rows, and a plurality of said second electrical connectors extending from each of said rows to said bar, each electrical connector from a row connected to said bar opposite a first electrical connector connected to a single different one of said columns, each row connected by said second electrical connectors to said bar at positions different from each other row;

means for connecting an electrical power supply to said patterns of electrical conductors to apply electric current to preselected opposed electrical connectors to produce heated areas in said bar.

* * * * *